United States Patent [19]

Nakazawa et al.

[11] 4,141,082

[45] Feb. 27, 1979

[54] WASH-AND-WEAR COAT

[75] Inventors: Itta Nakazawa; Isamu Kada, both of Otsu; Yoshiaki Fukutomi, Kyoto, all of Japan

[73] Assignee: Toray Textiles Inc., Tokyo, Japan

[21] Appl. No.: 846,343

[22] Filed: Oct. 28, 1977

[30] Foreign Application Priority Data

Oct. 29, 1976 [JP] Japan ..... 51-129418
Jan. 19, 1977 [JP] Japan ..... 52-4221

[51] Int. Cl.[2] ..... A41D 1/00
[52] U.S. Cl. ..... 2/93; 428/102; 428/246; 428/253
[58] Field of Search ..... 2/93, 97, 272, 87, 85, 2/DIG. 5, 94, 82; 26/18.5; 428/102, 246, 253

[56] References Cited

U.S. PATENT DOCUMENTS

| | | | |
|---|---|---|---|
| 2,919,443 | 1/1960 | Kashiyama | 2/94 |
| 2,967,306 | 1/1961 | Fabanich | 2/94 |
| 3,801,420 | 4/1974 | Anderson | 428/102 |

*Primary Examiner*—Doris L. Troutman
*Attorney, Agent, or Firm*—Finnegan, Henderson, Farabow & Garrett

[57] ABSTRACT

Disclosed is a wash-and-wear coat which comprises outer cloths, lining cloths, interlining cloths and sewing threads all of which exhibit very small shrinkage of 1% or less after laundering, the interlining cloths bonded to the outer cloths having a high peeling strength of at least 400 g/cm$^2$ after the first time of laundering and the lining cloths having a proper air permeability of from 100 to 300 ml/cm$^2$/second. The coat can be provided with a pocket located in the back part lining cloth of the coat which is capable of containing therein the coat itself.

3 Claims, 17 Drawing Figures

Fig. 5A
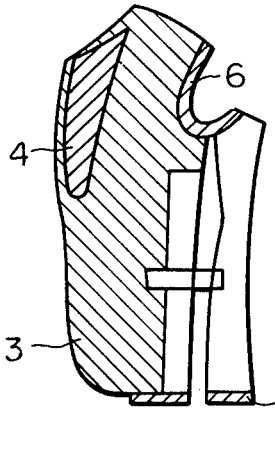
Fig. 5B
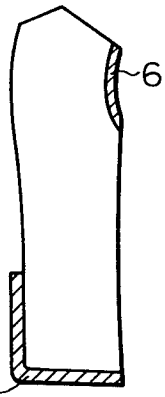
Fig. 5C
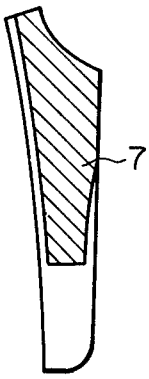
Fig. 5D
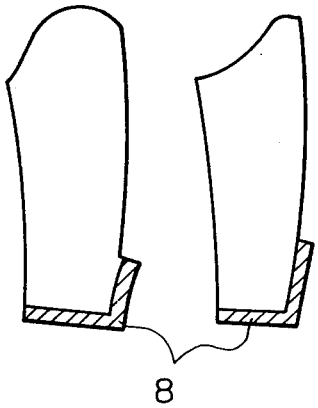
Fig. 5E
Fig. 5F
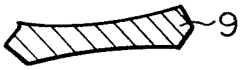
Fig. 5G
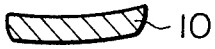
Fig. 5H
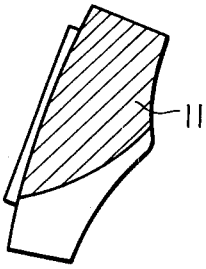

WASH-AND-WEAR COAT

The present invention relates to a wash-and-wear coat. More particularly, the present invention relates to a coat which can be laundered without undesirable deformation occurring thereto by using a household laundry machine, and which can be worn without ironing.

The term "coat" used herein pertains to men's coats, coats of men's suits, men's blazers, men's overcoats, men's short coats, men's half coats, men's uniform coats for military men, firemen and policemen, stand-up collar jackets, women's coat dresses, coats of women's suits, women's overcoats, women's half coats, women's tunic coats, etc.

BACKGROUND OF THE INVENTION

It is known that various textile fabrics exhibiting no or a very small change in dimensions after laundering can be prepared from various synthetic fibers, for example, polyester fibers, polyamide fibers or polyacrylic fibers. When such types of textile fabrics are used for making shirts, blouses or slacks, the finished clothes can be laundered by using a household laundry machine without any changes occurring to the dimensions and appearances of the laundered clothes, and worn directly without ironing or pressing. This type of clothing is known wash-and-wear clothing.

However, it is also known that when a conventional coat is laundered by using a household laundry machine, the laundered coat is no longer for practically wearable due to remarkable deformation of the coat. This deformation is sometimes caused by the differences in dimensional changes between parts of the coat, for example, outer cloths, lining cloths, interlining cloths and sewing threads used in the coat. Such deformation is also sometimes caused by the separation of the interlining cloths from the outer cloths. Furthermore, deformation of the coat is sometimes caused by local elongation of the coat due to the fact that when the laundered coat is hung to dry, a portion of the water contained in the laundered coat is retained locally within the coat over a long period during the drying process.

Under these circumstances, it is desirable to provide a wash-and-wear coat for consumers.

SUMMARY OF THE INVENTION

The object of the present invention is to provide a wash-and-wear coat which can be laundered by using a laundry machine without deformation of the coat occurring, and which can be worn directly without ironing or pressing.

The above-mentioned object can be fulfilled by the coat of the present invention which comprises outer cloths, lining cloths and interlining cloths consisting essentially of synthetic fibers and having a shrinkage of 1% or less, determined in accordance with the method of JIS (Japanese Industrial Standard) L 1042 corresponding to AATCC-96(1975), and sewing threads consisting essentially of synthetic fibers and having a shrinkage of 1.0% or less, determined in accordance with the A method of JIS L 1008; the interlining cloths being bonded to the outer cloths at a peeling strength of at least 400 g/2.54 cm, determined in accordance with the method of JIS L 1018 after the first time of laundering, in accordance with the F method of JIS L 1042, and; the lining cloths having an air permeability of from 100 to 300 ml/cm$^2$/second, determined in accordance with the method of JIS L 1079, corresponding to ASTM-D-737(1969).

When the coat of the present invention is laundered by using a household laundry machine, substantially no deformation and wrinkle formation are found on the laundered coat. Accordingly, the laundered coat can be worn directly without ironing or pressing.

The coat of the present invention may provide a special pocket in the lining cloths located in the back part of the coat. The special pocket can contain therein the whole coat itself by folding the coat onto the back side of the pocket and turning the pocket inside-out around the folded coat. The coat contained in its special pocket can be directly subjected to laundering.

DETAILED DESCRIPTION OF THE INVENTION

The coat of the present invention is made by using outer cloths, lining cloths and interlining cloths each consisting essentially of synthetic fibers and having a shrinkage of 1.0% or less, determined in accordance with the method of JIS L 1042. Also, the coat of the present invention is made by using sewing threads consisting essentially of synthetic fibers and having a shrinkage of 1.0% or less, determined in accordance with the A method of JIS L-1008.

In accordance with JIS L 1042, the shrinkages of the outer cloths, lining cloths and interlining cloths are measured as follows.

For treating each kind of cloth, three specimens, each having a length of 25 cm and a width of 25 cm are provided. On each specimen, three test lengths each measuring 20 cm are measured and marked off in parallel to each other and to the warp or wale direction of each specimen. Another three test lengths of 20 cm each are measured and marked off on each of the specimens, in parallel to each other and to the weft or course direction of each specimen. The specimens are laundered, rinsed and dried, under the conditions shown in Table 1. After completion of the drying step, the test lengths are measured. The length after drying is represented by "$l$". The shrinkage is calculated in accordance with the following equation.

$$\text{Shrinkage}(\%) = (20 - l/20) \times 100$$

The shrinkage in each direction of each specimen is represented by an average of the shrinkage of the three test lengths. The shrinkage in each direction of each cloth is represented by an average of the shrinkage of the three specimens.

Table 1

| Item | Condition |
|---|---|
| Laundry machine | Household electric laundry machine capable of automatically changing the rotating directon of a rotor at predetermined time intervals and of forming an eddy of laundry liquid |
| Laundry liquid stream | Strong |
| Laundry liquid | Solution of 0.1% by weight of an anionic weak-alkaline detergent |
| Liquor ratio | 1:50 |
| Amount of laundry liquid | 25 l |
| Laundry temperature | 30° C. |
| Laundry time | 10 minutes |
| Amount of material to be laundered | 500 g |
| Rinsing | With water for 3 minutes while excessive water is overflowed from the laundry machine, this operation is repeated two times |
| Removal of water | Centrifugalized for 30 seconds after the first time of rinsing |
| Drying | Drip-drying in ambient temperature |

The shrinkage of the sewing threads is measured in accordance with the A method of JIS L 1008, as follows.

Figure 1:
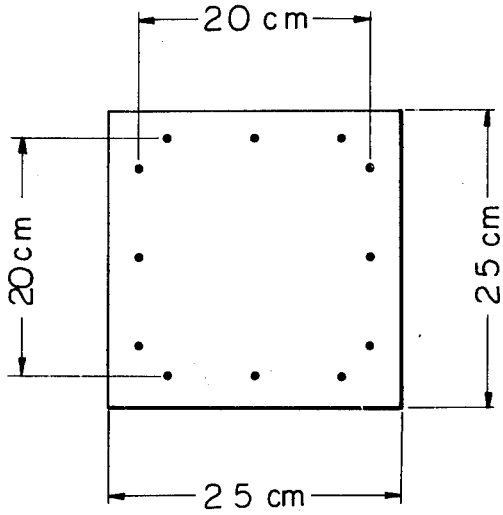
FIG. 1 shows a specimen for testing the shrinkage of the fabrics to be used for making the coat of the present invention.
Figure 2A:
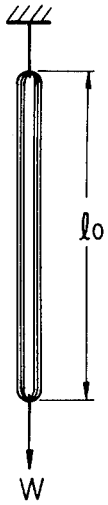
FIGS. 2A and 2B show a testing method for measuring the shrinkage of the sewing threads to be used for making the coat of the present invention.
Figure 2B:
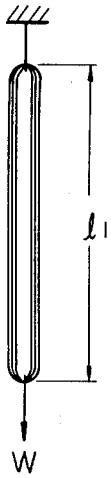

Five skeins each of 10 turns are provided by reeling a sewing thread on a reel. Each skein is subjected to a measurement of the length of the skein under a load ($w$) of 20 g by using a measuring device as shown in FIGS. 2A and 2B. The measured length of the skein is represented by $l_0$, as shown in FIG. 2A. The skeins are laundered, rinsed and then dried under the conditions shown in Table 1. Thereafter, the length ($l_1$) of the laundered skein is measured under a load ($w$) of 20 g, as shown in FIG. 2B. The shrinkage of the skein is calculated in accordance with the following equation:

$$\text{Shrinkage}(\%) = (l_0 - l_1/l_0) \times 100$$

The shrinkage of the sewing thread is represented by an average value of the shrinkage of the five skeins.

In the coat of the present invention, it is necessary that all of the outer cloths, lining cloths and interlining cloths in warp or wale and weft or course directions thereof and the sewing threads have a shrinkage of 1.0% or less, determined by the above-mentioned methods. Even if the shrinkages of the outer cloths in any of the above-mentioned directions are less than 1%, if the shrinkage of any one of the lining cloths, the interlining cloths or the sewing threads is larger than 1%, the laundering of the coat will result in undesirable deformation of the coat, formation of wrinkles on the outer cloths or puckering of the seam portions. If any one of the outer cloths, the lining cloths, the interlining cloths or the sewing thread has a large percentage of shrinkage of, for example, 2 to 2%, even if the difference in the shrinkages between any two items selected from the cloths and threads is 1% or less, laundering of the coat will still result in remarkable deformation of and wrinkle-formation on the coat.

In the coat of the present invention, the interlining cloths are adhered to the outer cloths. It is necessary that the strength of peeling the interlining cloth from the outer cloth be at least 400 g/2.54 cm after laundering once in accordance with the F method of JIS L 1042 under the conditions shown in Table 1. The adhesion of the interlining cloth to the outer cloth is not limited to a special manner of adhering. For example, the interlining cloth may be fusible at an elevated temperature, so that it can be fuse-bonded to the outer cloth. Also, the interlining cloth may be bonded to the outer cloth by using an adhesive. However, it is preferable that the interlining cloth to be used for the coat of the present invention be a fusible cloth. In this case, the interlining cloth may be adhered to the outer cloth by superimposing the interlining cloth on the outer cloth and pressing the resultant laminate at a temperature of from 150° to 170° C. under a pressure of from 200 to 500g/cm$^2$, for from 1 to 60 seconds.

Figure 3:
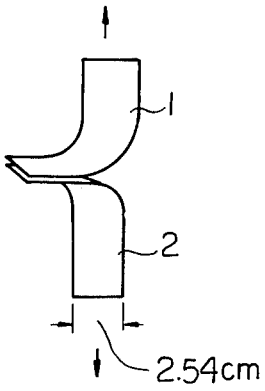
FIG. 3 shows a testing method for measuring the peeling strength of a interlining cloth bonded to a outer cloth of the coat of the present invention.

Referring to FIG. 3, in the measurement of peeling strength, five specimens were each prepared from a piece 1 of the interlining cloth having a length of 15 cm and a width of 2.54 cm, and from a piece 2 of the outer cloth having the same size as that of the piece of interlining cloth by adhering 5 cm long end portions of both pieces of cloths 1 and 2 to each other. The five specimens were laundered, rinsed and dried under the conditions shown in Table 1. Thereafter, both free ends of the pieces 1 and 2 were gripped and stretched at an angle of 180° so as to cause the piece of interlining cloth to be peeled from the piece of outer cloth. The load for the peeling was recorded by using an authograph, and the peeling strength was determined by using the recorded load in accordance with the B method mentioned in JIS L 1018.

The peeling strength of the interlining cloth from the outer cloth is represented in FIG. 3 by an average value of the peeling strengths of the five specimens. The peeling strength of the interlining cloth from the outer cloth before laundering is preferably at least 480 g/2.54 cm, more preferably, at least 500 g/2.54 cm. Also, it is preferable that the reduction in the peeling strength of the laminate of the outer cloth and the interlining cloth by laundering once is less than 35%, for example, 20 to 30%, based on the peeling strength of the laminate before laundering.

The coat of the present invention requires that the lining cloths used in the coat exhibit an air permeability of from 100 to 300 ml/cm$^2$/second, determined in accordance with the method of JIS L 1079.

Usually, after the coat is laundered and rinsed, the coat is drip-dried. During the drying period, water in the coat flows down and is retained in the skirt portions of the coat, particularly, in the parts in which the lower end portions of the outer cloths and the lining cloths are sewed together. This particular type of water retention causes the coat to be deformed and the seam portions to be broken. Also, such retention of water in the coat requires an undesirably long period of time for completely drying the coat. However, the undesirable phenomena mentioned above can be eliminated by using lining cloths having an air permeability of from 100 to 300 ml/cm$^2$/second, determined in accordance with the method of JIS L 1079.

Figure 4:
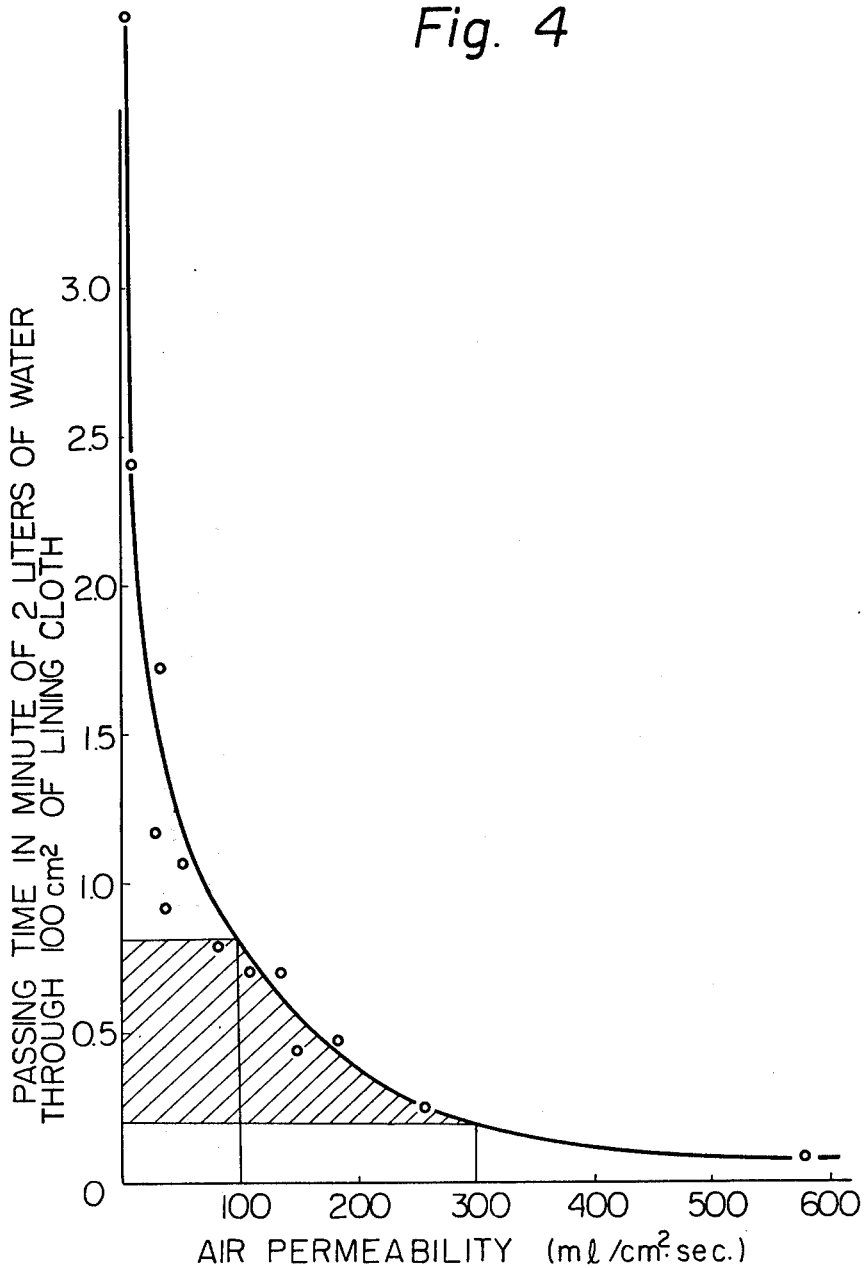
FIG. 4 is a graph showing the relationship between air permeability and water permeability of a lining cloth to be used for the coat of the present invention, FIGS. 5A through 5H respectively show locations of the interlining cloths in the coat of the present invention.

FIG. 4 shows the relationship between air permeability and water permeability of a lining cloth. That is, the time (in minutes) it takes for 2 liters of water to pass through 100 cm$^2$ of a lining cloth decreases with the increase in air permeability of the lining cloth. FIG. 4 also shows that if a lining cloth has an air permeability of from 100 to 300 ml/cm$^2$/second, then 2 liters of water can be allowed to pass through 100 $cm^2$ of the lining cloth within a very short time of about 10 to about 50 seconds. Accordingly, when the lining cloths having an air permeability of from 100 to 300 $ml/cm^2$/second is used, the laundered and rinsed coat can be uniformly dried without deformation and elongation occurring to the coat.

If the air permeability is less than 100 $ml/cm^2$/second, the resultant coat will need an undesirably long time for completing the drying process, and also will be deformed or elongated by the weight of the retained water. The lining cloth having an air permeability of more than 300 $ml/cm^2$/second requires only a short time for completely drying the coat. However, this lining cloth has a very small density and, therefore, is pervious to light to the extent that the interlining cloths and seam allowances of the coat can be seen through the rough lining cloths.

In the coat of the present invention, the outer cloths may be selected from woven fabrics and knitted fabrics consisting essentially of synthetic fibers, for example, polyester, polyamide and polyacrylic fibers. The woven fabrics and the knitted fabrics may be made of spun yarns containing at least 50% by weight of the synthetic staple fibers, or synthetic multifilament yarns. The fabrics may be a union fabric made of two or more synthetic fiber yarns different from each other.

The interlining cloths usable for the coat of the present invention consist essentially of synthetic fibers, for example, polyester, polyamide and polyacrylic fibers. For example, the interlining cloths may be selected from woven fabrics and knitted fabrics made of polyester multifilament yarns or spun yarns consisting of 50% or more by weight of polyester fibers and 50% or less by weight of cotton fibers, wool fibers, or viscose rayon fibers. The interlining cloths may be made of a nonwoven fabric consisting essentially of synthetic fibers. The interlining cloths may be coated with a resin having a relatively low melting point, for example, a copolymer of ethylene and nylon 6.

In the coat of the present invention, the interlining cloths may be located in portions indicated in FIGS. 5A through 5H. In FIGS. 5A and 5B, the front part of the coat has a front part interlining cloth 3, a lapel interlining cloth 4, a skirt part interlining cloths 5 and an armhole tape (interlining cloth) 6. Referring to FIG. 5C, the facing part of the coat has a facing interlining cloth 7. Referring to FIGS. 5D and 5E, the sleave of the coat has a cuff interlining cloth 8. Referring to FIG. 5F, the top collar part of the coat has a top collar interlining canvas 9. Referring to FIG. 5G, the stand-up part of the collar of the coat has a collar stand-up interlining canvas 10. Referring to FIG. 5H, the breast part of the coat has a breast pad canvas 11.

When the interlining cloths mentioned above are bonded to the outer cloths, it is preferable that the initial peeling strength be at least 480 g/2.54 cm, more preferably, 500 g/2.54 cm. The peeling strength tends to decrease due to wearing and laundering. However, the interlining cloths should not separate from the outer cloths due to wearing or laundering. Therefore, it is necessary that the peeling strength be at least 400 g/2.54 cm even after the first laundering.

The lining cloths usable for the coat of the present invention consist essentially of synthetic fibers. For example, the lining cloths may be selected from woven fabrics and knitted fabrics consisting of synthetic multifilament yarns. That is, the lining cloths may be of a taffeta or tricot fabric consisting of polyester or polyamide multifilament yarns.

The sewing threads usable for the coat of the present invention may also be made of a synthetic multifilament yarn or of a spun yarn consisting essentially of synthetic fibers. For example, the sewing thread can be made of a polyester or polyamide multifilament yarn or a spun yarn consisting of at least 50% polyester or polyamide fibers and the balance consisting of cotton fibers.

The manner of sewing the coat of the present invention is not restricted to a special method. However, it is preferable that the sewing operation be carried out by using a sewing machine, especially for sewing the lining cloths located in the skirt portions and the side portions of the coat. The edges of the collar, the lapels and the front cuts of the coat are preferably sewed by using decorative stitches.

The coat of the present invention can be laundered without deformation occurring thereto by using a household laundry machine. Thereafter, the laundered coat can be worn without any ironing. However, during the laundering process, sometimes troubles occur wherein the buttons of the coat are caught by the rotor of the laundry machine or are entangled with other clothing which are placed in the laundry machine together with the coat. In order to avoid such troubles, it is preferable that the coat be first placed in a net bag and then placed in the laundry machine.

In the coat of the present invention, a pocket for containing the coat may be provided in the lining cloth located on the back part of the coat. Before subjecting the coat to laundering, the coat is folded on the back side of the pocket. In the next step, the pocket is turned inside-out around the folded coat to contain the coat inside the turned pocket. By utilizing the pocket, the coat can be laundered without using any net bag.

Figure 6:
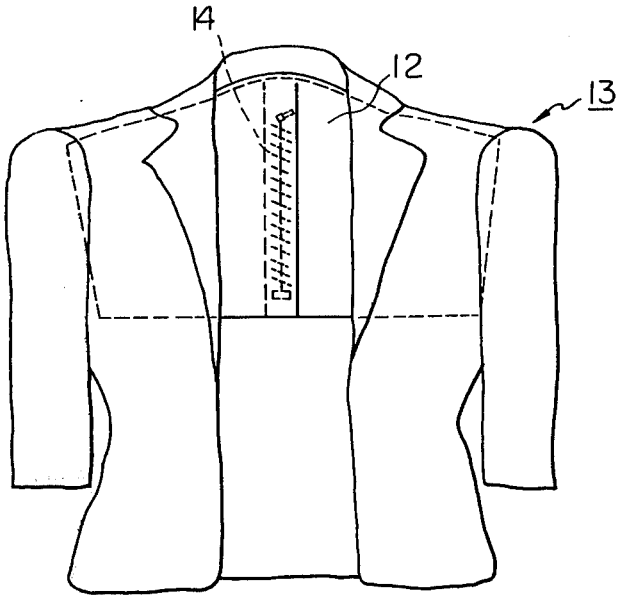
FIG. 6 shows a coat of the present invention having a special pocket.
Figure 7:
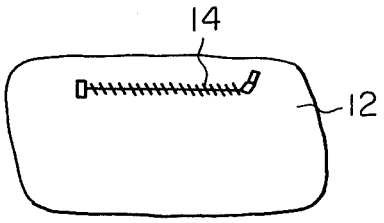
FIG. 7 shows the special pocket shown in FIG. 6 and containing therein the coat.

Referring to FIG. 6, a pocket 12 is provided on a lining cloth located on the back part of the coat 13. The pocket 12 has an entrance opening which can be closed with a fastener 14. The coat 13 is arranged on a working table so that the pocket 12 faces the table surface, and then the coat is folded onto the back side of the pocket 12. Then, the pocket 12 is turned inside-out around the folded coat so as to contain the coat inside the turned pocket. Referring to FIG. 7, after containing the coat inside the turned pocket 12, the pocket 12 is closed by fastening the fastener 14. The pocket 12 may be closed by using a fastening tape in place of the fastener shown in FIG. 6.

It is preferable that the opening of the pocket be covered by a portion of the lining cloth.

Figure 8:
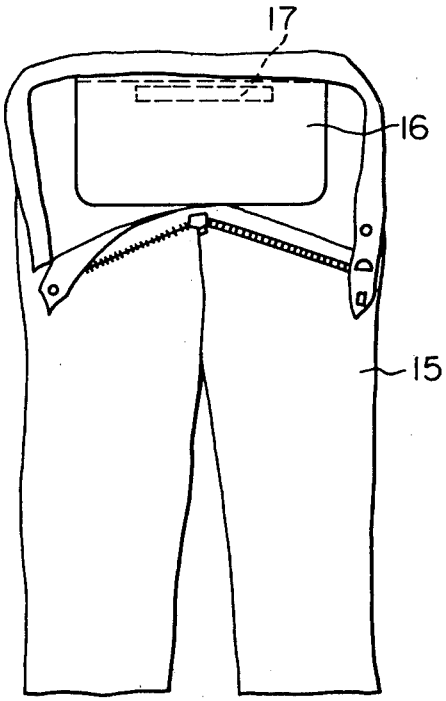
FIG. 8 shows trousers having a special pocket.
Figure 9:
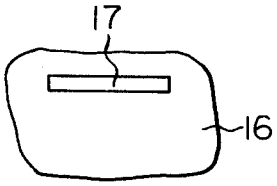
FIG. 9 shows the special pocket containing therein the trousers shown in FIG. 8.

In accordance with the idea described above, a pocket may be provided in a lining cloth located in the seat part of trousers in the manner shown in FIG. 8. Referring to FIG. 8, the trousers 15 have a pocket 16 in the lining cloth located in the seat part of the trousers. The opening of the pocket 16 can be closed by fastening a fastening tape 17. The trousers 15 are folded on the back side of the pocket 16; then, the pocket 16 is turned inside-out around the folded trousers so as to contain the trousers inside the turned pocket. Thereafter, the opening of the pocket 16 is closed by using the fastening tape 17.

The pocket mentioned above is preferably made of rough fabric exhibiting a high water permeability, for example, a net-like fabric such as a tricot mesh fabric. The pocket can, of course, be used as a ordinary pocket to contain therein things other than the coat or trousers, if desired.

As stated hereinbefore, the outer cloths of the coat of the present invention may be either a woven fabric or a knitted fabric. However, in the case where the above-mentioned pocket is utilized, the outer cloths are preferably made of a knitted fabric which has a high resistance to crease formation.

EXAMPLE

A men's two-piece suit was made. In the making of the suit coat, a double knitted fabric consisting of polyethylene terephthalate yarns was used as the outer cloths. The lining cloths, such as the back part lining cloths, front part lining cloths and sleeve lining cloths consisted of a tricot mesh fabric composed of polyethylene terephthalate yarns. The interlining cloths for the front parts, lapels, skirt portions, armholes, facing parts, cuffs, top collar, stand-up collar and breast pad of the coat were made from a non-woven fabric consisting of a mixture of polyethylene terephthalate fibers and nylon 6 fibers, and coated with a fusible resin consisting of an ethylene-nylon 6 copolymer. The sewing thread used for making the coat was of a thickness of class No. 50 and consisted of a polyethylene terephthalate multifilament yarn.

The trousers of the suit were made by using the same materials as those used for the coat. While making the trousers, the lining cloths were placed in the seat part of the trousers and the interlining cloths were placed in the waist band, tack and front part.

All of the outer cloths, lining cloths, interlining cloths and sewing threads had shrinkages less than 1%, which were determined in accordance with the aformentioned methods. The interlining cloth was bonded to the outer cloth by pressing both at a temperature of 160° C±2° C., under a pressure of 300 g/cm$^2$, for 3 seconds. After the first laundering, the bonded interlining cloth and the outer cloth had a peeling strength of 450 g/cm. The lining cloth had an air permeability of 250 ml/cm$^2$/second.

The resultant suit was worn for five weeks and laundered at equal intervals of once per week using the laundry method mentioned hereinbefore. After the third and fifth times of laundering, the appearance of the suit was examined and changes in the dimensions of the suit were measured. It was confirmed that there was substantially no formation of wrinkles, pills and snags, deformation or seam puckering in the suit. All of the pleats in the suit were retained substantially in the same state as that before laundering. That is, substantially no changes in the appearance and the dimensions of the suit were observed. When the laundered and rinsed suit was drip-dried, water was not retained between the outer cloths and the lining cloths. Therefore, the suit could be rapidly dried and worn without ironing.

What we claim is:

1. A wash-and-wear coat comprised of outer cloths, lining cloths and interlining cloths, all consisting essentially of synthetic fibers and having a shrinkage of 1.0% or less, determined in accordance with the method of JIS L 1042, and sewing threads consisting essentially of synthetic fibers and having a shrinkage of 1.0% or less, determined in accordance with the A method of JIS L 1008, said interlining cloths being bonded to said outer cloths at a peeling strength of at least 400 g/2.54 cm, determined in accordance with the B method of JIS L 1018, after the first time of laundering in accordance with the H method of JIS L 1018, and said lining cloths having an air permeability of from 100 to 300 ml/cm$^2$/second, determined in accordance with the method of JIS L 1079.

2. A wash-and-wear coat as claimed in claim 1, wherein said outer cloths consist of either a woven fabric or a knitted fabric.

3. A wash-and-wear coat as claimed in claim 1, wherein said lining cloth located in the back part of said coat has a special pocket which has a capacity large enough for containing therein said coat.

* * * * *